US008567646B1

(12) United States Patent
Cray

(10) Patent No.: US 8,567,646 B1
(45) Date of Patent: Oct. 29, 2013

(54) PORTABLE FUEL CAN AND NOZZLE ASSEMBLY WITH PRESSURE RELIEF

(76) Inventor: Thomas M. Cray, Lenexa, KS (US)

( * ) Notice: Subject to any disclaimer, the term of this patent is extended or adjusted under 35 U.S.C. 154(b) by 125 days.

(21) Appl. No.: 13/066,348

(22) Filed: Apr. 12, 2011

Related U.S. Application Data

(60) Provisional application No. 61/342,283, filed on Apr. 12, 2010.

(51) Int. Cl.
*B67D 3/00* (2006.01)

(52) U.S. Cl.
USPC ..... 222/482; 222/478; 222/481.5

(58) Field of Classification Search
USPC ..... 222/380, 481.5, 482, 562, 478, 488, 222/529
See application file for complete search history.

(56) References Cited

U.S. PATENT DOCUMENTS

| | | | | | |
|---|---|---|---|---|---|
| 4,063,667 | A | | 12/1977 | Flider | 222/470 |
| 4,746,036 | A | | 5/1988 | Messner | 222/484 |
| 4,834,151 | A | * | 5/1989 | Law | 141/198 |
| 4,834,270 | A | | 5/1989 | Messner | 222/484 |
| 4,924,921 | A | * | 5/1990 | Simmel et al. | 141/286 |
| 5,076,333 | A | * | 12/1991 | Law | 141/198 |
| 5,129,426 | A | * | 7/1992 | Boehmer | 137/854 |
| 5,228,487 | A | | 7/1993 | Thiermann et al. | 141/293 |
| 5,234,038 | A | | 8/1993 | Mitchell et al. | 141/293 |
| 5,249,611 | A | * | 10/1993 | Law | 141/198 |
| 5,406,994 | A | | 4/1995 | Mitchell et al. | 141/198 |
| 5,419,378 | A | * | 5/1995 | Law | 141/198 |
| 5,628,352 | A | | 5/1997 | Gracyalny et al. | 141/198 |
| 5,704,408 | A | | 1/1998 | Law | 141/198 |
| 5,762,117 | A | | 6/1998 | Law | 141/198 |
| 5,799,688 | A | | 9/1998 | Yie | 137/505.13 |
| 5,988,458 | A | | 11/1999 | Messner | 222/478 |
| 6,036,061 | A | * | 3/2000 | O'Donnell | 222/539 |
| 6,227,419 | B1 | * | 5/2001 | Raboin | 222/484 |
| 6,318,604 | B1 | | 11/2001 | Messner | 222/478 |
| 6,435,380 | B1 | | 8/2002 | Raboin | 222/484 |
| 6,484,765 | B1 | | 11/2002 | Clemmons et al. | 141/292 |
| 6,598,630 | B1 | | 7/2003 | Trippi, Jr. | 141/350 |
| 6,619,341 | B2 | | 9/2003 | Cushing | 141/198 |
| 6,702,248 | B2 | * | 3/2004 | Treat | 251/28 |
| 6,726,059 | B2 | * | 4/2004 | Treat | 222/3 |
| 6,871,680 | B2 | * | 3/2005 | Trippi, Jr. | 141/350 |
| 6,889,732 | B2 | | 5/2005 | Allen | 141/353 |
| 6,968,875 | B2 | * | 11/2005 | Nielsen | 141/351 |
| 7,089,975 | B2 | * | 8/2006 | Chrisco et al. | 141/286 |
| 7,108,157 | B2 | | 9/2006 | Alei | 222/153.06 |
| 7,128,108 | B2 | | 10/2006 | Nielsen | 141/351 |
| 2008/0135793 | A1 | * | 6/2008 | Forbis et al. | 251/309 |

* cited by examiner

*Primary Examiner* — Kevin P Shaver
*Assistant Examiner* — Christopher Luzecky
(74) *Attorney, Agent, or Firm* — Jonathan A. Bay

(57) ABSTRACT

A nozzle assembly for a portable fuel can has the following. A cap provision for generally sealing vapors inside a contained volume inside the combined nozzle assembly and portable fuel can. A spout to dispense liquid fuel. A main valve for the liquid fuel which automatically closes in the absence of manual operation. A manual operator for manually and selectively opening the main valve. Porting providing vacuum venting whereby gases are admitted into the contained volume as the liquid fuel level pours out of the can, whereby the vacuum venting allows for gaseous exchange between the can as liquid fuel empties therefrom and the target container liquid-fuel fills in and flushes out gases due to the rising fuel level therein. Wherein the vacuum venting comprising and intake port disposed to provide automatic overflow cutoff. At least one over-pressurization relief break, and at least one under-pressurization relief break.

13 Claims, 6 Drawing Sheets

PORTABLE FUEL CAN AND NOZZLE ASSEMBLY WITH PRESSURE RELIEF

CROSS-REFERENCE TO PROVISIONAL APPLICATION(S)

This application claims the benefit of U.S. Provisional Application No. 61/342,283, filed Apr. 12, 2010.

BACKGROUND AND SUMMARY OF THE INVENTION

The invention relates to fluid handling and, more particularly, to a portable fuel can and nozzle assembly with pressure relief.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
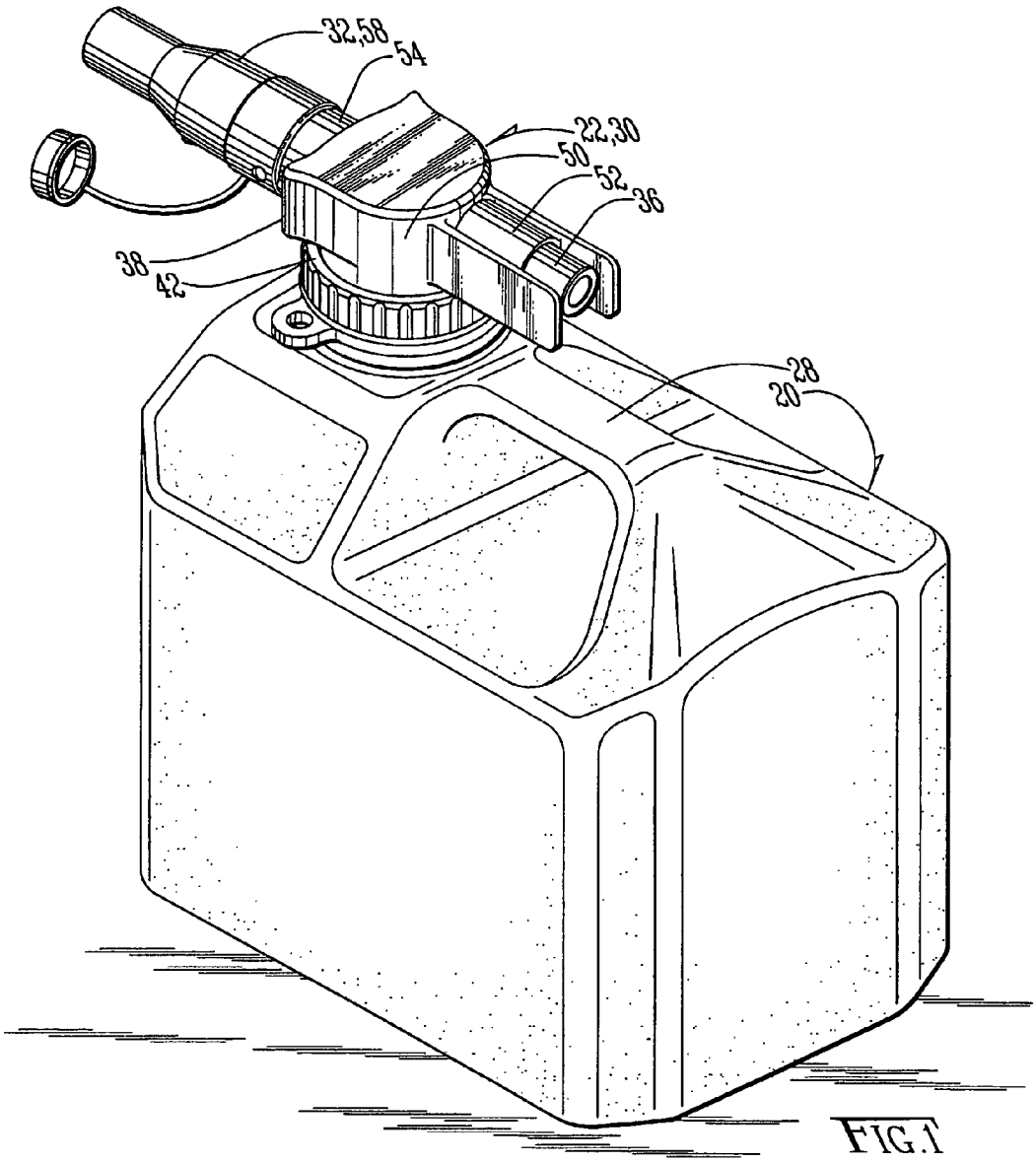
FIG. 1 is a perspective view of a portable fuel can and nozzle assembly with pressure relief in accordance with the invention.
Figure 2:
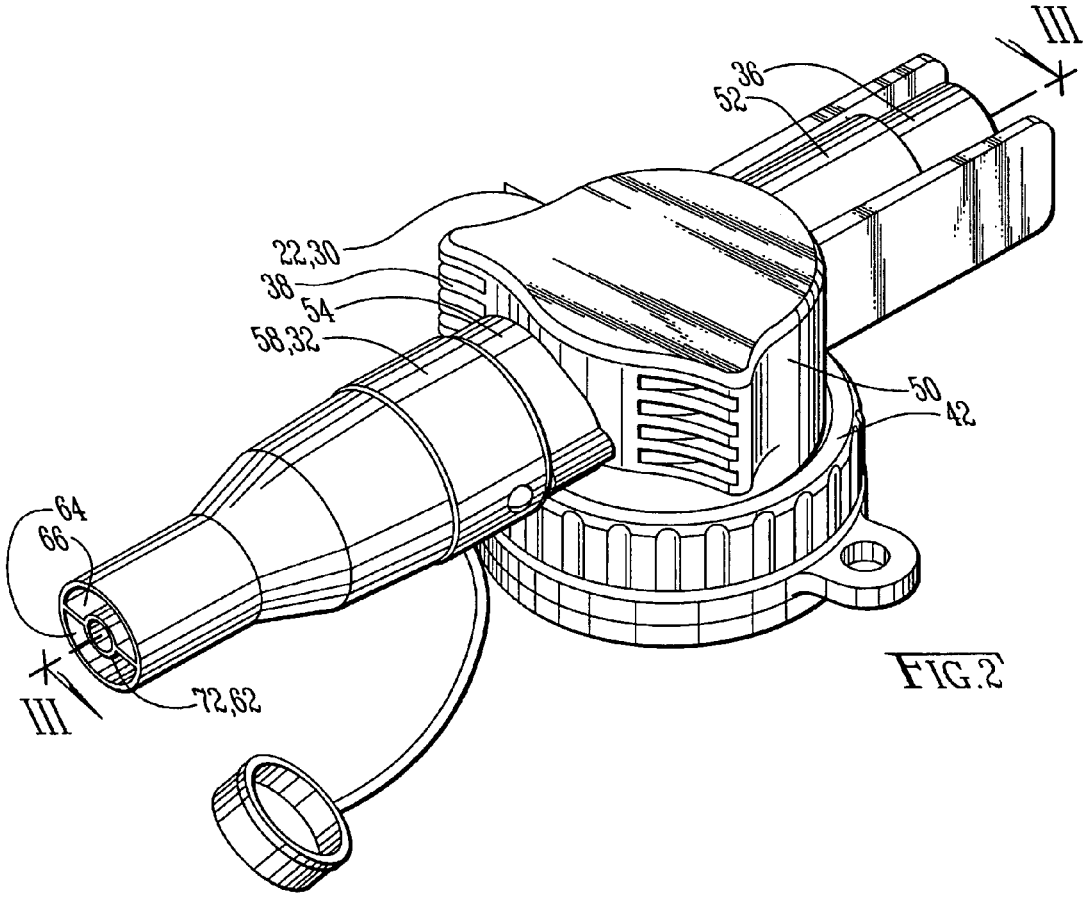
FIG. 2 is an enlarged-scale perspective view of fuel nozzle assembly in isolation.
Figure 3:
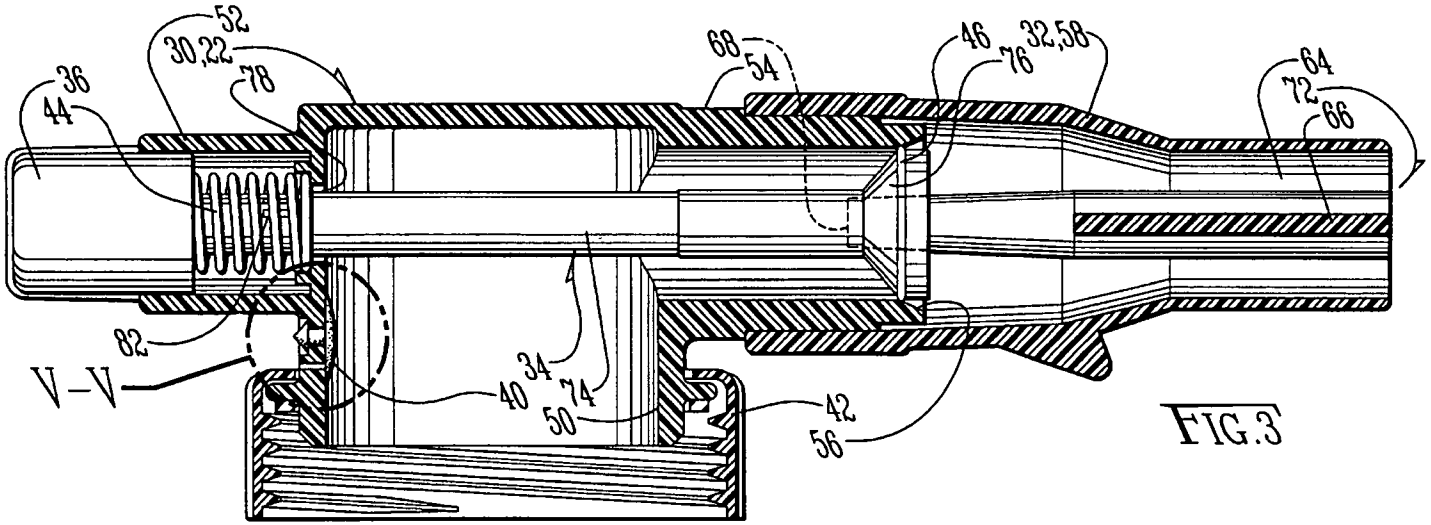
FIG. 3 is a partial sectional view taken along line in FIG. 2.

FIGS. 1 and 3 show a combined portable fuel can 20 and nozzle assembly 22 with pressure relief in accordance with the invention.

Preferably the portable fuel can 20 provides just a single opening which serves both re-fill and pour functions. This opening is surrounded by a threaded neck. The nozzle assembly 22 screws onto this threaded neck. With general reference to FIG. 1 through 5, the nozzle assembly 22 serves a number of functions. A non-exclusive list includes, without limitation, the following.

1—It is a cap 30 (eg., to cover the can 20's re-fill/pour opening and generally seal vapors inside the contained volume inside the combined nozzle assembly 22 and portable fuel can 20).

2—It is a spout 32 (eg., to dispense fuel into a target, such as a tank of a vehicle or the like, which is not shown).

3—It has an automatically CLOSED main valve 34, so that during non-use, the main valve 34 is CLOSED and the vapors are generally sealed inside the contained volume of the can/nozzle assembly 20/22.

4—It has a manual operator (eg., thumb button 36 is preferred) so that during use, a user can selectively OPEN the main valve 34 and pour, with precise control.

5(a)—During pouring operations, it provides vacuum venting or, that is, the admission of air (or vapors and/or admixtures thereof) into the contained volume as the fuel level drains in the can 20, and in order to prevent the walls of the can 20 from collapsing or else choking off the pour.

5(a)—During pouring operations, it provides for more than mere vacuum venting, it provides for gaseous exchange:—ie., the can 20 while emptying is suctioning out the gases, (eg., generally, 'vapor,' likely, a mix of true vapor diluted by air) that are being flushed out by the rising fuel level in the tank-being-filled.

6—It provides automatic overflow cutoff.

7—It and/or the can 20 or else both in combination might provide a handle 28 or handles 38 for the user.

8—During non-use, in order to prevent damage due to over-pressurization, it provides for over-pressurization self-relief and cracks a seal 46,56 to allow escape of vapors until the pressure differential between vapors in the can 20 and ambient are within an acceptable range (eg., over-pressurization relief).

9—During non-use, in order to prevent damage due to under-pressurization, it provides for under-pressurization self-relief and cracks a vacuum-relief seal 40 or 97 to allow admission of air until the pressure differential between the vapors in the can 20 and ambient are again within an acceptable range (eg., a vacuum-relief valve 40 or 97, and in contrast to vacuum venting through inlet port 72 during pouring).

The nozzle assembly 22 is accompanied by a retaining collar 42. The retaining collar 42 actually screws onto the threaded neck of the can 20 in order to seal the re-fill/pour opening with the nozzle assembly 22. The collar 42 screws tight onto the neck, forcing an air-tight seal between mating flanges of the neck and the nozzle assembly 22. Preferably the fuel can 20, the collar 42, and most of the components of the nozzle assembly 22 are produced out of plastic materials (wherein, spring steel is preferably used to make a spring 44 and elastomeric materials are preferably used to make an O-ring 46, grommet serving as a ring seal 78, umbrella valve 40 and/or O-ring 97 serving as the under-pressurization seals).

The nozzle assembly 22 includes a hollow T-shaped cap 30, a pour spout 32, a main valve 34, and thumb button 36 to manually operate the main valve 34.

The hollow T-shaped cap 30 has a bottom-ported cylindrical stem 50 (ie., which is closed across the top) with one reduced-size ported arm 52 extending rearward and another reduced-size ported arm 54 extending forward on about the same linear axis as the rearward arm 52. The bottom-ported cylindrical stem 50 and the reduced-size ported arm 54 that extends forward both include interior volume that is part of the greater contained volume of the can/nozzle assembly 20/22 as a whole.

The rear ported arm 52 essentially serves as a receiver for the thumb button 36. More particularly, it is preferred if the rear ported arm 52 essentially serves as a hollow cylindrical track for sliding reciprocation of the thumb button 36. The forward ported arm 54 serves both as a valve seat 56 as well as a nipple on which the spout 32 is affixed.

The spout 32 comprises a hollow outer sleeve 58 and a hollow inner sleeve 62. The hollow inner sleeve 62 is, in other words, the vent intake tube 62. The inner and outer sleeves 58 and 62 are fixed together by a pair of flanking webs 66 to define an annular pour conduit 64. The vent intake tube 62 extends between inner and outer open ends 68 and 72 and serves as the vacuum venting conduit during the pour. The outer open end 72 serves as the vent intake port. During pouring, make-up gases are suctioned into portable fuel can 20 by way of the vent intake port 72. If the pour is into, say, an open container such as a coffee can, then the make-up gases are going to be air for the most part. At the same time during the pour, fuel pours out (needless to say) through the annular pour conduit 64 between the inner and outer sleeves 68 and 72 (fuel pouring out is not shown).

If the spout 32 is disposed into a confined container, say, the neck of a fuel tank (neither tank nor neck thereof are shown), there will actually be an exchange of gases. That is, the nozzle assembly 22 will suction in through the vent intake port 72 of the spout 32 the needed make-up gases (ie., generally a mixture of 'true' fuel vapor and air) for the emptying can 20 from the pushed-out gases needing to escape from the filling tank. That is, the pushed-out gases from the filling tank will be suctioned into the emptying can 20 to make up for the increase in volume in the can 20 for gases due to the fuel dispensed out therefrom.

The main valve 34 comprises a tubular valve stem 74 that extends between a closed end affixed to the thumb button 36 and an open end that telescopes over the spout 32's vent intake tube 62 at the inner open end 68 thereof and forms a sliding seal with the vent intake tube 62. The valve stem 74's open end flares out as a conic valve member 76. As stated above, the forward ported arm 54 serves in part as the valve seat 56.

Figure 4:
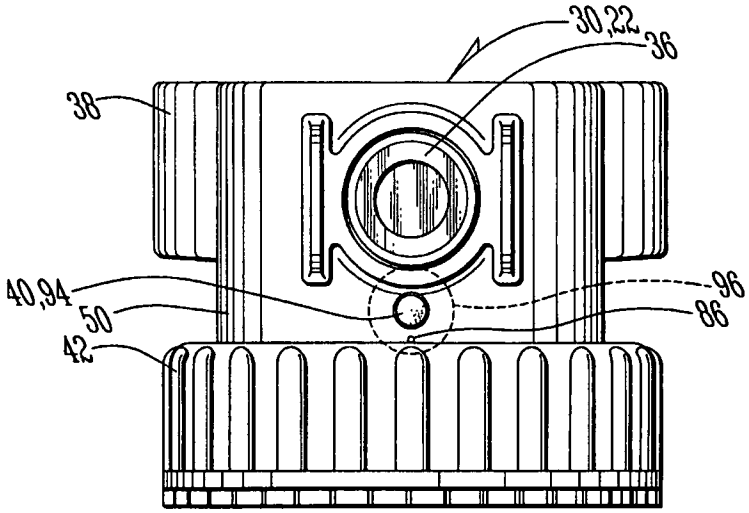
FIG. 4 is a front elevational view thereof.

FIG. 4 shows the valve member 76 closed against the valve seat 56, to form an air tight seal. The tubular valve stem 74 inserts through a ring seal 78 for it in the rearward ported arm 52. A compression spring 44 compressible between the thumb button 36 and a flange surface surrounding the ring seal 78 on the valve stem 74 automatically forces the valve member 76 shut against the valve seat 56.

Hence the valve seat 56 and valve member 76 form one air tight seal. The ring seal 78 around the valve stem 74 forms another. Thus the contained gaseous gases (and the liquid fuel) are sealed inside the combined contained volume of the can 20' and nozzle assembly 22. It can be discerned that the valve stem 74 has ventilation apertures 82 formed in the sidewall thereof rear of the ring seal 78.

In use, a user tips the spout 32 down until liquid fuel fills the forward ported arm 54 until backed up against the valve member 76. When the user depresses the button 36, the valve stem 74 is thrust forward until the ventilation apertures 82 slide forward of the ring seal 78 and into the (until now) sealed interior volume of the can 20 and nozzle assembly 22. The T-shaped cap 30 has a pair of flanking ears 38 serving as handles and/or finger rests for the middle and index finger of the hand used to depress the button 36 with the thumb thereof. The seal is broken at the valve seat 56. With the same thrust of the valve stem 74, the ventilation apertures 82 are inside the ring seal 78. Liquid fuel flows out across the valve seat 56. The vacuum venting of make-up air or vapors are suctioned into the vent intake port 72 and dispersed into the combined interior volume of the can 20 and nozzle assembly 22 via the ventilation apertures 82 in the valve stem 74.

When the user lets off the button 36, the compression spring 44 automatically drives the main valve 34 to shut, stopping the pour of liquid fuel. Alternatively, if the fuel level of the tank-to-be-filled floods to the level where the fuel level submerges the vent intake port 72, then the pour of liquid fuel is likewise automatically shut-off by the virtue of choking off the vent intake port 72 from the suctioning in of make-up gases (air and/or vapors).

The foregoing has described the conditions of the can/nozzle assembly combination 20/22 being sealed and vented (and back to being sealed again) in connection with pouring. In connection with long non-use during storage or transport, there is further interest in the pressure differential between ambient and the vapors sealed in the closed can/nozzle assembly 20/22. The pressure differential can go either way. That is, the vapors contained inside the can/nozzle assembly 20/22 can be either over-pressurized relative ambient, or under-pressurized.

FIG. 3 shows better that, the combination can 20 and nozzle assembly 22 in accordance with the invention is provided with self-relief of over-pressurization by the following design. The compression spring 44 is designed to yield if the pressure against the back of the valve member 76 exceeds a design set-point. That is, if the pressure inside the can 20 and nozzle assembly 22 exceeds the design set-point, the vapors are permitted to leak out past the cracked-open valve member 76. It is preferred to leak vapors out of the over-pressurized can 20 rather than keep the vapors corked inside until the over-pressurization damages the can 20's sidewalls and/or components of the nozzle assembly 22. Hence, among its other functions, the main valve 34 also functions as an over-pressure relief valve.

Figure 5:
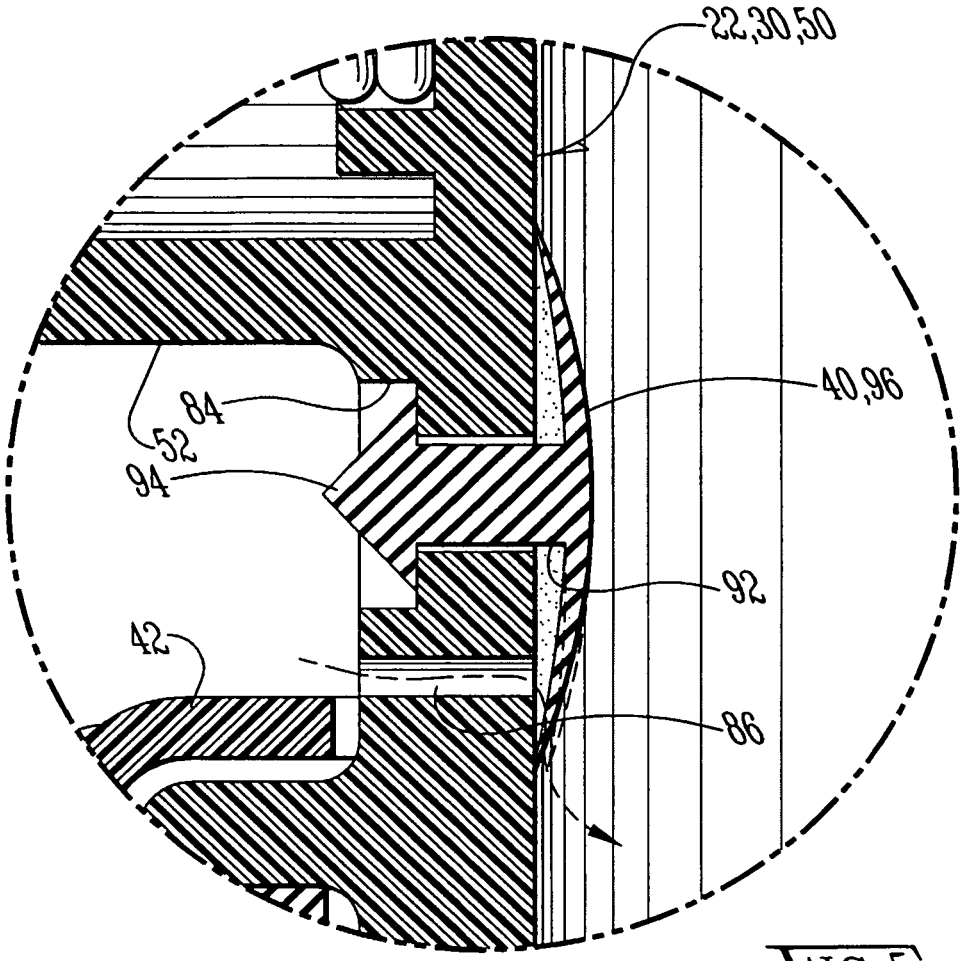
FIG. 5 is an enlarged scale perspective view of detail V-V in FIG. 3.

FIGS. 4 and 5 show better that, the combination can 20 and nozzle assembly 22 in accordance with the invention is provided with self-relief of under-pressurization by a vacuum relief valve 40. This particular design includes without limitation a push-in version of an elastomeric umbrella valve 40. The umbrella valve 40 functions as a one-way valve. The bottom-ported cylindrical stem 50 of the T-shaped cap 30 has a pair of apertures 84 and 86 formed in its sidewall, one larger than the other. The umbrella valve 40 comprises a shaft 92 extending between a barbed end 94 and an annular umbrella canopy 96. The shaft 92 gets pushed into the larger hole 84 (eg., the mounting hole), barbed end 94 first, from inside the T-shaped cap 30. The smaller hole 86 is situated close enough such that the annular canopy 96 of the umbrella valve 40 laps over this hole, the vacuum-relief port 86. The push-in valve 40's shaft 92 forms a permanent seal with the mounting hole 84 for it in the cap 30's sidewall. In contrast, the push-in valve 40's annular canopy 96 forms merely a temporary seal over the vacuum-relief port 86 under conditions of over-pressurization or light under-pressurization. When the under-pressurization exceeds a design set-point value, the elastomeric canopy 96 cracks the seal over the vacuum-relief port 86, allowing an intake of fresh air, and hence preventing the can 20's sidewall from crushing in on itself.

Optionally, the vacuum-relief valve 40 can be re-located from being mounted on the nozzle assembly 22 to instead on the portable fuel can 20.

Figure 6:
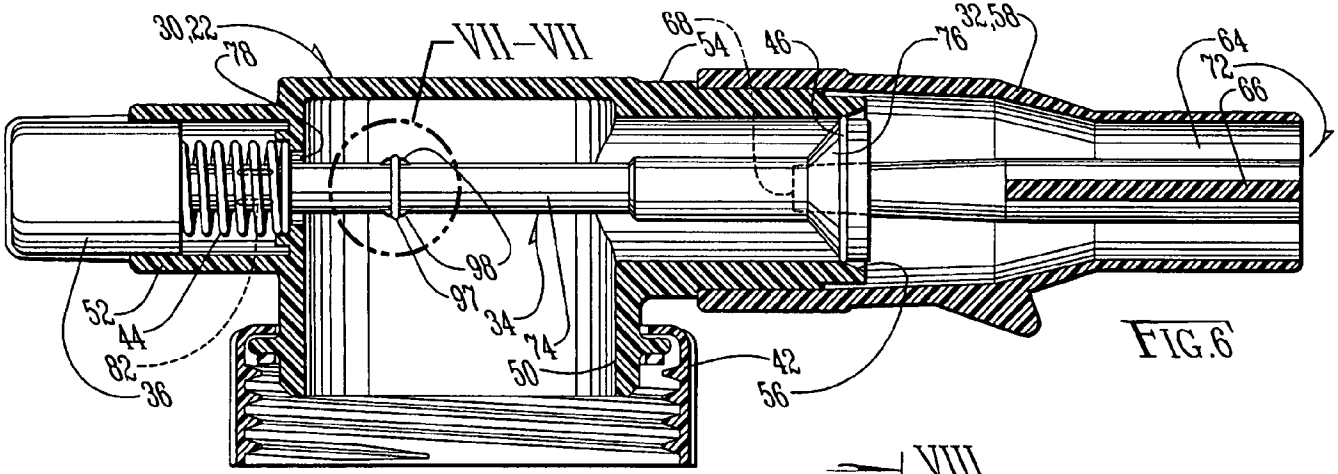
FIG. 6 is a partial sectional view comparable to FIG. 2 except showing an alternate embodiment of under-pressurization relief.
Figure 7:
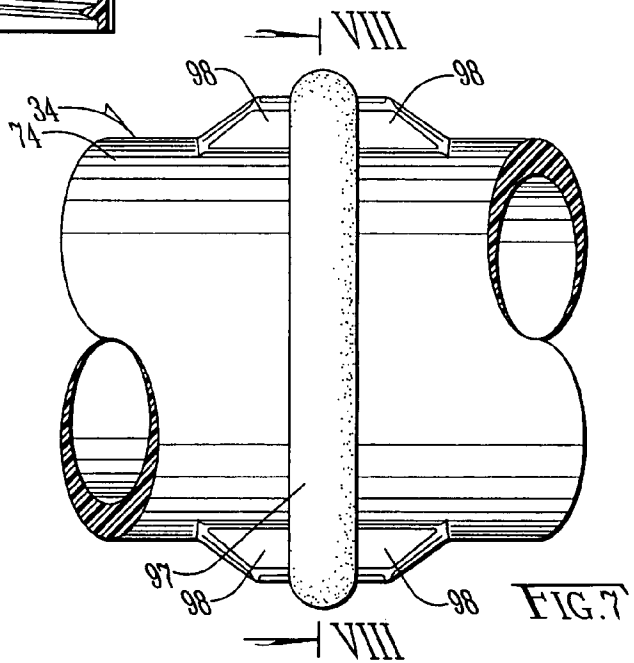
FIG. 7 is an enlarged scale elevational view of detail VII-VII in FIG. 6.
Figure 8:
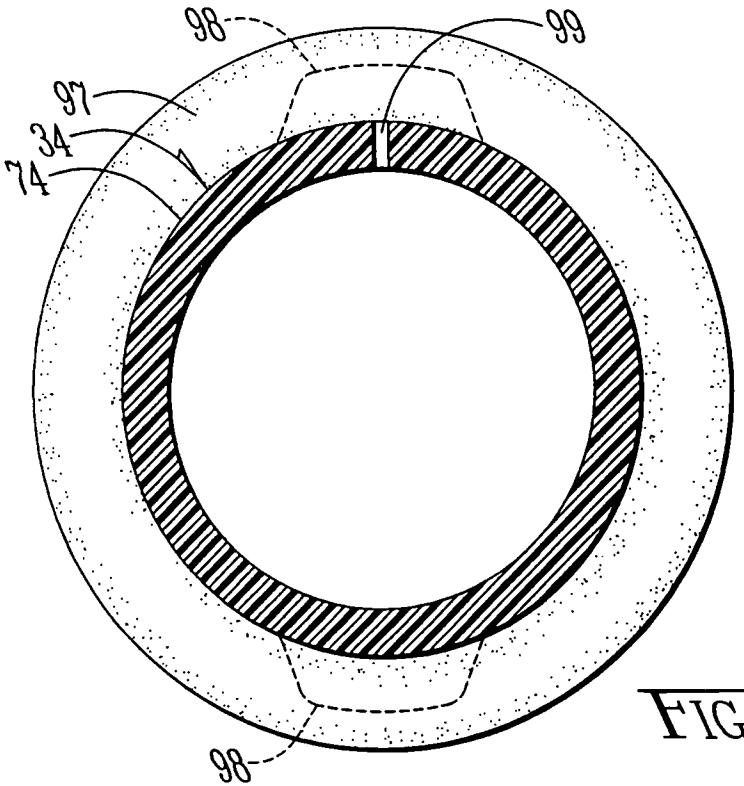
FIG. 8 is a partial sectional view taken along line VIII-VIII in FIG. 7.

FIGS. 6 through 8 show an alternate embodiment in which the combination of the can 20 (not shown in these views) and nozzle assembly 22 in accordance with the invention is provided with self-relief of under-pressurization by a vacuum relieving (or vacuum breaking) O-ring 97. The relief valve 40 is omitted in these views. The vacuum breaking O-ring 97 functions as a one-way valve. As FIG. 6 shows better, the vacuum breaking O-ring is encircled around hollow valve stem 74 of main valve 34. When the main valve 34 is in the closed position, the hollow interior of the valve stem 74 is not in communication for vapor exchange with the vapors inside the greater confined volume of the can/nozzle assembly 20/22. Instead, the hollow interior of the valve stem 74 is open to the atmosphere at vent intake port end 72 and also as well at ventilation apertures 82.

Again, the vacuum breaking O-ring 97 snugly/tightly encircles the valve stem 74. The valve stem 74 is formed with two pair of retention seats 98. The retention seats 98 comprise nodes (or bumps) of material extending out of the sidewall of the valve stem 74.

By way of non-limiting example, one pair of retention seats 98 are illustrated as flanking the O-ring 97 at the twelve o'clock position of the valve stem 74. The other pair of retention seats 98 are illustrated as flanking the O-ring 97 at the six o'clock position of the valve stem 74. The ordinarily skilled artisan would routinely understand how to routinely vary the illustrated design into numerous routine variations of what is drawn in the drawing figures, and still be guided by the present disclosure.

FIGS. 7 and 8 together show the coordinated features of the vacuum-breaking O-ring 97 and the retention seats 98. FIG. 8 shows that the pair of retention seats 98 at the twelve o'clock position flank a pin-hole sized 99 aperture serving as a vacuum-breaking port 99.

The retention seats 98 are only circumferentially formed around the circumference of the valve stem 74 by a minuscule amount. The six o'clock seats 98 cooperate more than adequately with the twelve o'clock seats 98 to retain the O-ring 97 in the preferred axial station along the axis of the valve stem 74. The twelve o'clock seats 98 flank the preferred and sole vacuum-breaking port 99. The outlet of the vacuum-breaking port 99 in the sidewall of the valve stem 74 is positioned at the bottom of the trough between the twelve o'clock seats 98.

When the gases in the can 20 are pressurized in equilibrium with ambient, the vacuum-breaking O-ring 97 seats to form a seal over the vacuum-breaking port 99 as pinched (seated) among (i) the twelve o'clock seats 98 and (ii) the trough therebetween being the sidewall of valve stem 74 between those twelve o'clock seats 98. Hence there is not any under-pressurization condition, nor any under-pressurization relief.

When the gases in the can 20 are over-pressurized relative to ambient, the vacuum-breaking O-ring 97 is compressed thereby to form even a tighter seal over the vacuum-breaking port 99.

When the gases in the can 20 are under-pressurized by a depressed amount selected by design, the vacuum-breaking O-ring 97 yields to leakage into the greater contained volume of the can/nozzle assembly 20/22, and hence intake of air into the greater contained volume of the can/nozzle assembly 20/22. The air supply fills the hollow interior of the valve stem 74 either and/or both through the vent intake port 72 and/or ventilation apertures 99.

In all the text herein of this patent document, the term "vapor" has any of the following meanings according to context:—1—fuel vapor, 2—admixture of fuel vapor and air, and/or 3—gases or gaseous mixtures in general, whether clean or entrained.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A portable fuel can (20) and nozzle assembly (22), comprising:

a hollow plastic portable fuel can (20) that has only a single opening, which serves both re-fill and pour functions;

a nozzle assembly (22) affixed to the fuel can (20)'s single opening;

said nozzle assembly (22) comprising a plastic cap portion (30); a pour port (54); a main valve (34) operable between OPENED for dispensing liquid fuel and CLOSED for generally sealing vapors inside a combined contained volume of the portable fuel can (20) and affixed nozzle assembly (22) during extended non-use; a manual operator (36) for manually operating the main valve (34) to OPENED; and, a closing device (44) for maintaining the main valve (34) CLOSED in the absence of manual operation and during extended non-use;

at least one over-pressurization relief break (34,44,46,56) configured for relieving over-pressurization conditions in the plastic portable fuel can (20) at times long after pour operations were discontinued and thus during the extended non-use of said plastic portable fuel can (20), all while the self-closing main valve (34) is maintained closed by the closing device (44) therefor, and for the purpose of preventing damage to said plastic portable fuel can (20) due to over-pressurization during extended non-use; and at least one under-pressurization relief break (40,86,97,99) configured for relieving under-pressurization conditions in the plastic portable fuel can (20) at times long after pour operations were discontinued and thus during extended non-use of said plastic portable fuel can (20), all while the self-closing main valve (34) is maintained closed by the closing device (44) therefor, and for the purpose of preventing damage to said plastic portable fuel can (20) due to under-pressurization during extended non-use;

wherein, the at least one under-pressurization relief break (97,99) comprises:

a hollow tubular conduit (74) extending inside the combined contained volume of the portable fuel can (20) and affixed nozzle assembly (22) and being formed with an under-pressurization relief port (99) therein;

said hollow tubular conduit (74) engaging the cap portion (30) to form a seal (46,78) for generally sealing vapors inside the combined contained volume of the portable fuel can (20) and affixed nozzle assembly (22) during extended non-use;

said hollow tubular conduit (74) having at least one port (72, 82) outside of the combined contained volume of the portable fuel can (20) and affixed nozzle assembly (22), which port (72, 82) is open to ambient pressure during non-use and thereby pressurizes the hollow tubular conduit (74) to ambient pressure during non-use;

further comprising a resilient band (97) encircling the hollow tubular conduit (74) and covering the under-pressurization relief port (99) which is inside the combined contained volume of the portable fuel can (20) and affixed nozzle assembly (22), whereby over-pressurization tends to more forcefully force the resilient band (97) to seal off the under-pressurization relief port (99) against the escape of vapors; and wherein circumference and resiliency of the resilient band (97) are sized and selected such that, if the under-pressurization pressure between ambient and the combined contained volume of the portable fuel can (20) and affixed nozzle assembly (22) dips below a set-point, the resilient band (97) resiliently yields over the under-pressurization relief port (99) and leaks ambient gases inside.

2. The portable fuel can (20) and nozzle assembly (22) of claim 1, wherein:

the resilient band (97) comprises an O-ring.

3. The portable fuel can (20) and nozzle assembly (22) of claim 1 wherein:

all said over-pressurization relief breaks (34,44,46,56) and all said under-pressurization relief breaks (40,86,97,99) are provided by the nozzle assembly (22) and none by the portable fuel can (20).

4. The portable fuel can (20) and nozzle assembly (22) of claim 3 wherein:

the over-pressurization relief break (34,44,46,56) has a biasing member (44) which determines the pressure set-point for the over-pressurization relief, and the under-pressurization relief break (40,86,97,99) has an independent biasing member (96,97) which determines the pressure set-point for the under-pressurization relief.

5. The portable fuel can (20) and nozzle assembly (22) of claim 4 wherein:

the manual operator (36) further comprises a biasing member (44); and the over-pressurization relief break (34,44,46,56)'s biasing member (44) also serves as the manual operator (36)'s biasing member (44).

6. The portable fuel can (20) and nozzle assembly (22) of claim 2, wherein:

the hollow tubular conduit (74) comprises an outer surface in which the under-pressurization relief port (99) is formed therein; and the hollow tubular conduit (74)'s outer surface is formed with a retention formation (98) for axially retaining the O-ring (97) over the under-pressurization relief port (99).

7. The portable fuel can (20) and nozzle assembly (22) of claim 6, wherein:

the retention formation (98) comprises at least a pair of retention seats (98), each of the pair of retention seats axially flanking the O-ring (97) on opposite sides of the under-pressurization relief port (99).

8. The portable fuel can (20) and nozzle assembly (22) of claim 1, further comprising a combined vacuum venting/automatic overflow cutoff provision (62,72,74,82), comprising:

a hollow tubular conduit (74,62) extending inside the combined contained volume of the portable fuel can (20) and affixed nozzle assembly (22) and originating in a gas-exchange intake port (76,72) proximate the liquid-fuel pour port (54,64) such that flooding the liquid-fuel pour port (54,64) contemporaneously floods the gas-exchange intake port (76,72) and thereby provides automatic overflow cutoff;

wherein manually operating the manual operator (36) furthermore OPENS a ventilation port (82) to the combined contained volume of the portable fuel can (20) and affixed nozzle assembly (22) and thereafter CLOSES the ventilation port (82) thereto during extended non-use.

9. The portable fuel can (20) and nozzle assembly (22) of claim 1, wherein, the at least one under-pressurization relief break (40,86,97,99) comprises:

the nozzle assembly (22) being formed with at least one under-pressurization relief port (86,99) inside the combined contained volume of the portable fuel can (20) and affixed nozzle assembly (22) through some portion of a sidewall (50,74) of the nozzle assembly (22), which said at least one under-pressurization relief port (86,99) is open to ambient pressure during non-use; and further comprising an elastomeric cover (96,97) supported by the sidewall (50,74) for covering the under-pressurization relief port (86,99) inside the combined contained volume of the portable fuel can (20) and affixed nozzle assembly (22);

wherein over-pressurization tends to more forcefully force the elastomeric cover (96,97) to seal off the under-pressurization relief port (86,99) against the escape of vapors; and wherein under-pressurization pressure between ambient and the combined contained volume of the portable fuel can (20) and affixed nozzle assembly (22) below a set-point un-covers the elastomeric cover (96,97) off the under-pressurization relief port (86,99) and thereby leaks ambient gases inside.

10. The portable fuel can (20) and nozzle assembly (22) of claim 9, wherein:

the elastomeric cover (96) comprises a canopy of an umbrella valve (40).

11. The portable fuel can (20) and nozzle assembly (22) of claim 9, wherein:

the elastomeric cover (97) comprises an O-ring (97).

12. The portable fuel can (20) and nozzle assembly (22) of claim 11, further comprising a combined vacuum venting/automatic overflow cutoff provision (62,72,74,82), comprising:

a hollow tubular conduit (74,62) extending inside the combined contained volume of the portable fuel can (20) and affixed nozzle assembly (22) and originating in a gas-exchange intake port (76,72) proximate the liquid-fuel pour port (54,64) such that flooding the liquid-fuel pour port (54,64) contemporaneously floods the gas-exchange intake port (76,72) and thereby provides automatic overflow cutoff;

wherein manually operating the manual operator (36) furthermore OPENS a ventilation port (82) to the combined contained volume of the portable fuel can (20) and affixed nozzle assembly (22) and thereafter CLOSES the ventilation port (82) thereto during extended non-use; and wherein the under-pressurization relief port (99) is formed in the hollow tubular conduit (74).

13. The portable fuel can (20) and nozzle assembly (22) of claim 12, wherein:

the main valve (34) and manual operator (36) are cooperatively linked to serve the over-pressure relief valve (34, 44,46,56).

* * * * *